US007407228B1

(12) United States Patent
Infanti

(10) Patent No.: US 7,407,228 B1
(45) Date of Patent: Aug. 5, 2008

(54) SEAT STRUCTURE FOR A GAMING MACHINE

(76) Inventor: Vittorio Infanti, 3075 Richmond Ter., Staten Island, NY (US) 10303

( * ) Notice: Subject to any disclaimer, the term of this patent is extended or adjusted under 35 U.S.C. 154(b) by 0 days.

(21) Appl. No.: 11/604,102

(22) Filed: Nov. 27, 2006

(51) Int. Cl.
*A47C 31/00* (2006.01)
*A47C 1/00* (2006.01)
*A47B 97/00* (2006.01)

(52) U.S. Cl. ..... 297/217.7; 297/344.19; 248/500

(58) Field of Classification Search ..... 297/175, 297/451.5, 451.6, 451.4, 217.7, 217.3, 217.1, 297/172, 344.18, 344.19, 344.21, 344.22; 108/147.2; 248/501, 500, 510, 680, 503.1, 248/418

See application file for complete search history.

(56) References Cited

U.S. PATENT DOCUMENTS 1,111,586 A * 9/1914 Hurlbert ..... 297/461
3,266,840 A * 8/1966 D'Estrube ..... 297/158.3
5,083,738 A * 1/1992 Infanti ..... 248/500
5,102,192 A * 4/1992 Barile, Sr. ..... 297/257
5,114,112 A * 5/1992 Infanti ..... 248/500
5,232,191 A * 8/1993 Infanti ..... 248/500
5,409,296 A * 4/1995 Barile ..... 297/344.1
5,522,641 A 6/1996 Infanti ..... 297/344.1
5,542,748 A * 8/1996 Barile ..... 297/463.1
5,678,886 A 10/1997 Infanti ..... 297/217.3
5,762,617 A * 6/1998 Infanti ..... 601/49
5,791,731 A 8/1998 Infanti ..... 297/217.3
6,354,660 B1 * 3/2002 Friedrich ..... 297/217.1
6,502,800 B1 * 1/2003 Ursini et al. ..... 248/500
6,572,187 B2 * 6/2003 Laufer ..... 297/217.1

* cited by examiner

*Primary Examiner*—Milton Nelson, Jr.
(74) *Attorney, Agent, or Firm*—LaMorte & Associates

(57) ABSTRACT

A system for mounting a seat to the front of a gaming machine. A base platform is provided that has a front edge. At least one hole is disposed in the base platform proximate its front edge. A seat is attached to the base platform utilizing a vertical column. The vertical column is adjustable in height between a fully extended position and a fully retracted position. The vertical column holds the seat in a position facing the gaming machine. However, when the vertical column is in its fully retracted position, the seat can be turned ninety degrees to facilitate a person entering or exiting the seat. A locking mechanism joins the base platform to the gaming machine. Authorized personnel can only open the locking mechanism.

16 Claims, 6 Drawing Sheets

SEAT STRUCTURE FOR A GAMING MACHINE

BACKGROUND OF THE INVENTION

1. Field of the Invention

In general, the present invention relates to chairs that are placed in front of gaming machines, such as slot machines and video games. More particularly, the present invention relates to the structure of chairs and the anchoring systems used to mount the chairs.

2. Prior Art Description

Most all casinos have gaming machines in the form of slot machines, video poker machines and the like. In order to make such games more enjoyable to play, casinos most often provide chairs in front of many of the gaming machines. Casinos speculate that a person will remain at a gaming machine longer, and spend more money, if they are comfortable while playing the gaming machine. As a consequence, casinos spend a lot of money and effort in designing and installing seating for the gaming machines.

Placing a chair in front of a gaming machine seems simple, but it has many complications. If a chair is not anchored, it can be moved by patrons. Accordingly, some gaming machines will not have chairs available to those who want to play those gaming machines. Furthermore, unanchored chair are a tripping hazard to people walking around a crowded casino floor. This is especially true if a chair has been moved into a walkway. Additionally, unanchored chairs can be easily tipped over, and therefore present a danger to both the patrons seated in the chairs and the patrons surrounding the chairs.

It is for these reasons that many casinos elect to use anchored chairs rather than unanchored chairs. Anchored chairs are set into fixed positions in front of the gaming machines. In this manner, the chairs cannot be moved or tipped over. However, placing a chair in a fixed position in front of a gaming machine presents other problems for a casino.

Casinos often rearrange the positions of the gaming machines on the casino floor in order to make room for new games or just to provide variety. If a chair is affixed to the floor in front of a gaming machine, the chair must be removed when the gaming machine is moved. The chair must then be reaffixed to the floor in front of the new position of the gaming machine. This dramatically increases the cost and labor involved with moving a gaming machine.

Furthermore, many gaming machines have access doors through which the gaming machine is serviced and through which money is collected. Often the access doors are on the front of the gaming machine. If a chair is set into place directly in front of a gaming machine, access to the doors is restricted. The gaming machines, therefore, must be pulled away from the anchored chair in order to be emptied or serviced.

Recognizing the problems of mounting chairs to the casino floor in front of gaming machines, casinos have begun to use systems that mount chairs directly to the gaming machine, rather than the casino floor. In this manner, the chair can be moved with the gaming machine. In such systems, the chair can be selectively removed from the gaming machine when the gaming machine needs to be emptied or serviced, thereby eliminating the inconveniences of floor mounted chairs. Such gaming machine mounted chair systems are exemplified by U.S. Pat. No. 5,791,731 to Infanti, the current applicant, entitled Adjustable Game Stool Assembly With Flat Base.

In such prior art systems, a platform is provided on the floor in front of the gaming machine. The chair sits upon the platform. One end of the platform attaches to the gaming machine at floor level. The platform connects to the gaming machine using a manually operated locking mechanism. However, the locking mechanism is exposed. Consequently, the locking mechanism can be either accidentally or intentional opened by a patron sitting at the gaming machine. Furthermore, the locking mechanism is exposed to spilled drinks, dirt, debris and innumerable foot kicks that can damage the locking mechanism and make it hard to operate.

A need therefore exists for an improved chair assembly that interconnects with a casino gaming machine but does so in a manner that protects the locking mechanism from patrons and the environment of the casino. This need is met by the present invention as described and claimed below.

Another problem associated with providing an anchored chair to a gaming machine is one of positioning the chair. People come in all shapes and sizes. It is difficult to provide a chair in one fixed position that is ergonomically comfortable to a majority of people. If a chair is too close to a gaming machine, large patrons cannot sit in the seat. If a chair is placed too far from a gaming machine, small patrons cannot comfortably reach the gaming machine.

In the prior art, there are systems that enable the height and incline of gaming machine chairs to be adjusted. Such prior art systems are exemplified by some of the applicant's prior patents, which include U.S. Pat. No. 5,678,886 to Infanti, entitled Adjustable Game Stool Assembly and U.S. Pat. No. 5,522,641 to Infanti, entitled Adjustable Game Stool Assembly. However, these prior art systems do not address the problem of how to have an anchored chair that is both accessible by large patrons and close enough to the gaming machine for smaller patrons.

A need therefore also exists for a gaming machine chair that is close enough to a gaming machine to be comfortable for smaller patrons, yet provides enough room for a larger patron to comfortably access the chair. This need is also met by the present invention as described and claimed below.

SUMMARY OF THE INVENTION

The present invention is a system for mounting a seat to the front of a gaming machine or similar object. A seat is provided. Furthermore, a base platform is provided that has a front edge and a top surface. At least one hole is disposed in the base platform proximate its front edge. The seat is attached to the base platform utilizing a vertical column.

The vertical column has a bottom end that is connected to the base platform and a top end that is connected to the seat. The vertical column is adjustable in height between a fully extended position and a fully retracted position. The vertical column holds the seat in a position facing the gaming machine. However, when the vertical column is in its fully retracted position, the seat can be turned ninety degrees to the left or right to facilitate a person entering or exiting the seat.

A locking mechanism is coupled to the gaming machine. The locking mechanism contains at least one pawl that is biased downwardly below the locking mechanism. The pawl automatically engages one of the holes in the base platform when the base platform is advanced under the locking mechanism, therein selectively joining the base platform to the gaming machine.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention seating system can be used to attach a seat to many items, such as a restaurant counter, it is particularly well suited for use with a casino gaming machine. Accordingly, the exemplary embodiment of the present invention seating system that is illustrated shows the seating system applied to the vertical face of a casino gaming machine. The selection of the exemplary embodiment is only intended to present one of the best modes contemplated for the invention. However, the exemplary embodiment should not be considered a limitation on the seating system. It should therefore be understood that the present invention system can be used to mount a seat to any vertical surface.

Figure 1:
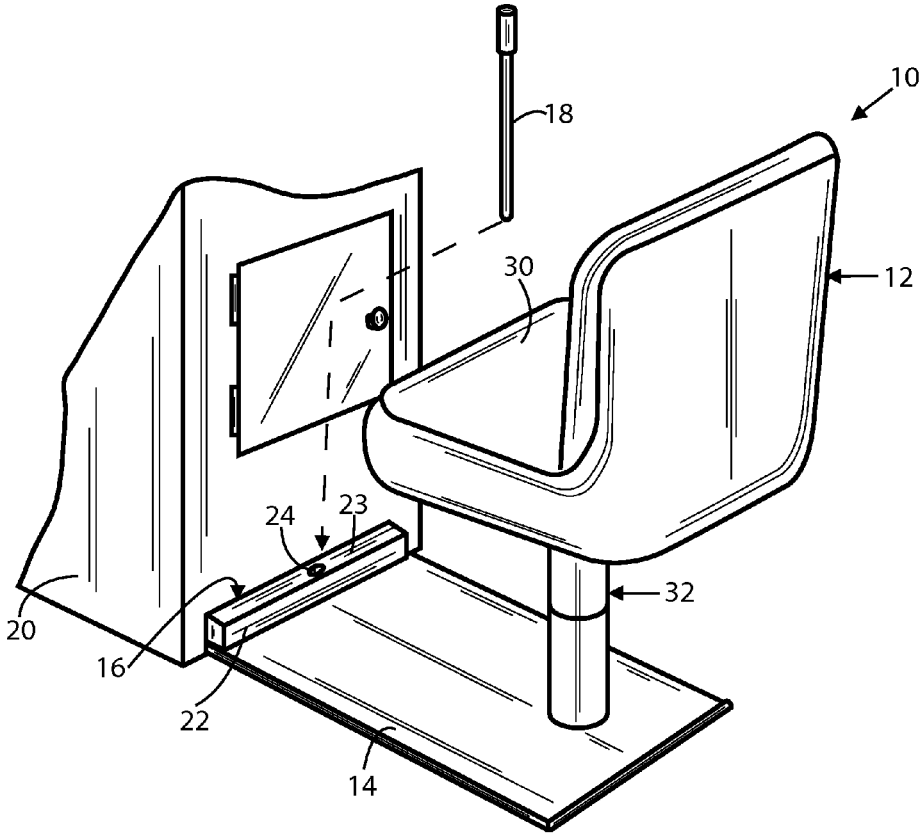
FIG. 1 shows a perspective view of an exemplary embodiment of the present invention seating system.
Figure 2:
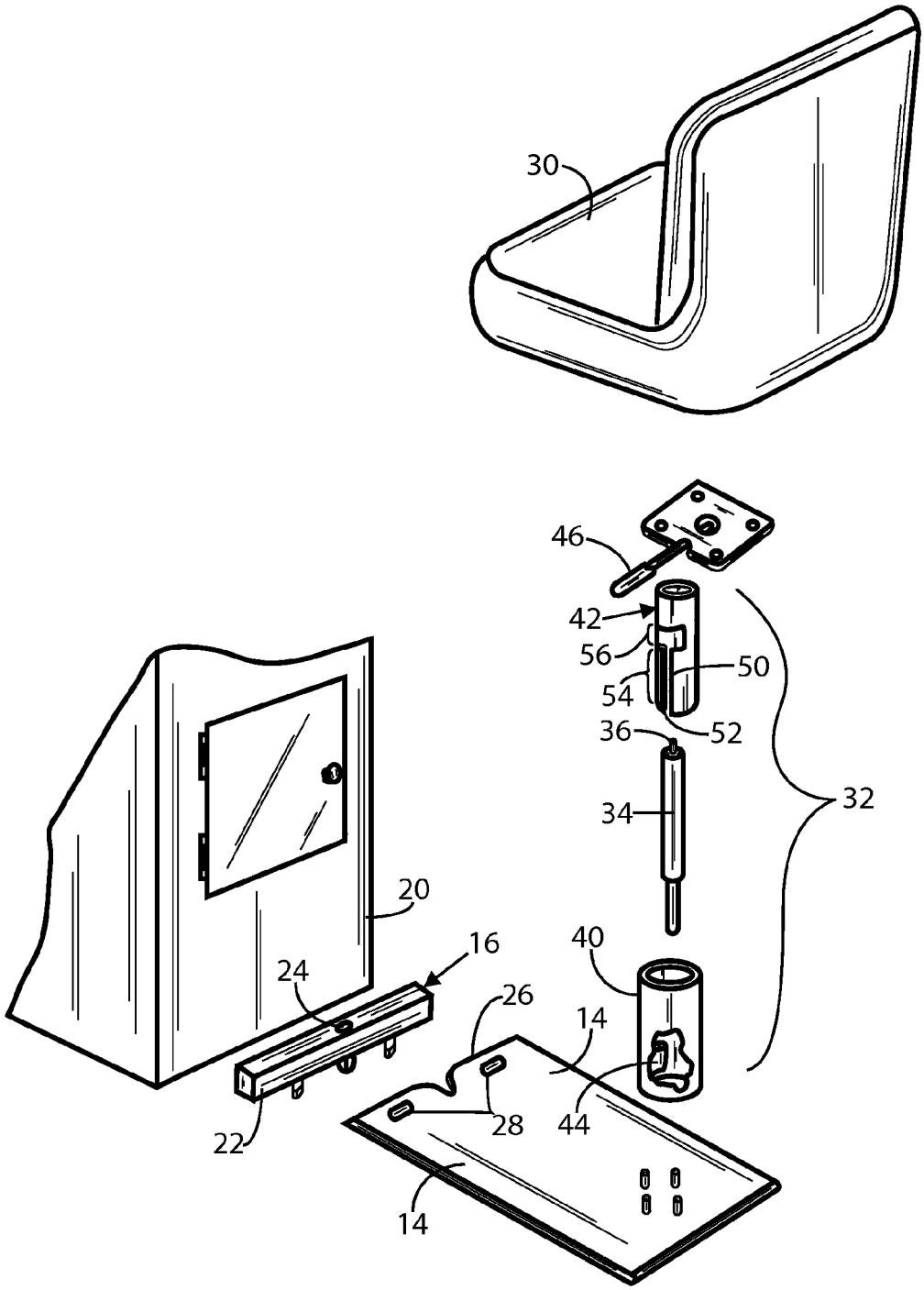
FIG. 2 is an exploded view of the embodiment of FIG. 1.

Referring to FIG. 1, in conjunction with FIG. 2, there is shown an exemplary embodiment of the seating system 10. The seating system 10 includes a chair assembly 12, a base platform 14, a locking mechanism 16 and an elongated actuator 18.

The locking mechanism 16 is affixed to the front of a gaming machine 20 just above floor level. The locking mechanism 16 includes a housing 22 that protects the inner workings of the locking mechanism 16. A small aperture 24 is formed in the top surface 23 of the housing 22. As will later be explained in more detail, the locking mechanism 16 can be selectively opened by advancing an elongated actuator 18 into the aperture 24.

The base platform 14 has a forward edge 26. A plurality of holes 28 are disposed in the base platform 14 proximate the forward edge 26. It is the holes 28 on the base platform 14 that are engaged by the locking mechanism 16 on the gaming machine 20, when the forward edge 26 of the base platform 14 is advanced on the floor under the locking mechanism 16.

The chair assembly 12 includes a seat 30 and an adjustable support column 32 that joins the seat 30 to the base platform 14. As will later be explained, the support column 32 enables the seat 30 to be selectively adjusted up and down in height. The support column 32 also enables the seat 30 to be selectively manipulated between a playing position, where the seat 30 faces the gaming machine 20 and a loading position, where the seat 30 is turned ninety degrees from the playing position.

Figure 3:
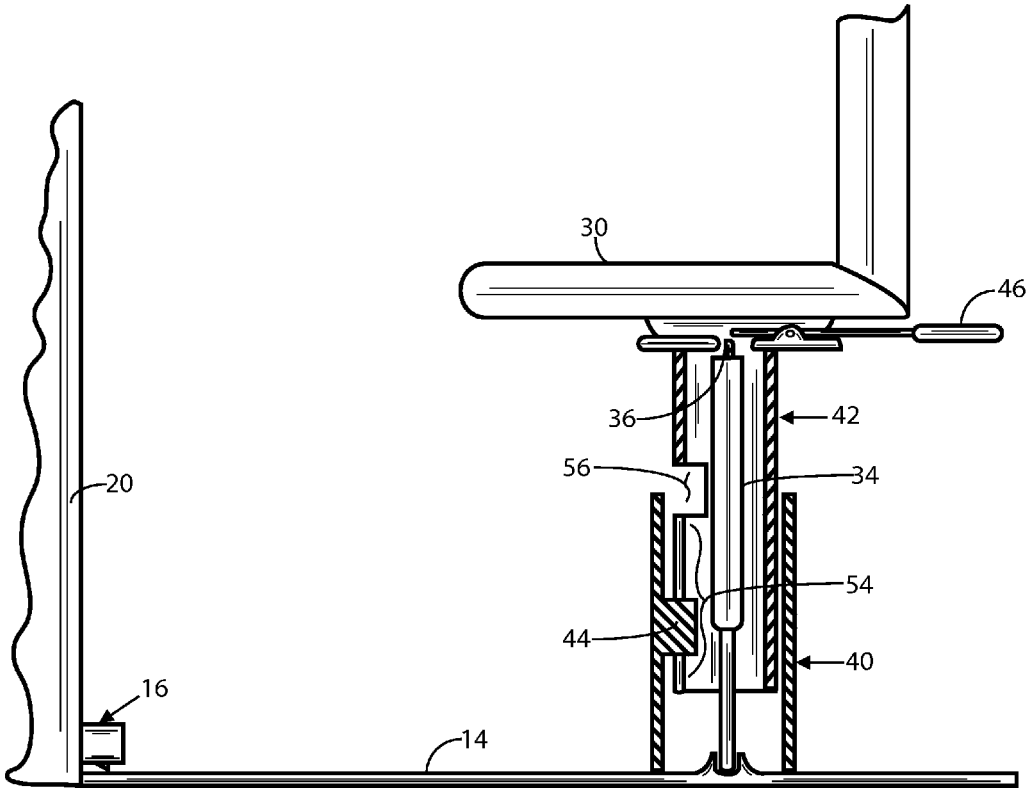
FIG. 3 is a selectively cross-sectioned view of the vertical column component of the present invention.

Referring to FIG. 2, in conjunction with FIG. 3, it can be seen that within the support column 32 is a pneumatic piston 34 that is used to adjust the vertical height of the support column 32. The piston 34 is a standard chair piston, having an activation valve 36 at its top end.

The pneumatic piston 34 is placed in the center of two telescoping column sections 40, 42. The bottom column section 40 is bolted directly to the base platform 14 and is therefore set in one position relative the base platform 14.

An inwardly projecting cam 44 is disposed in the interior of the bottom column section 40. The cam 44 extends only a short distance inwardly so as not to interfere with the pneumatic piston 34 in the center of the support column 32.

The top column section 42 bolts to the bottom of the seat 30. Accordingly, the seat 30 and the top column section 42 move together. An adjustment lever 46 extends into the top column section 42. The adjustment lever 46 engages the activation valve 36 on the top of the pneumatic piston 34 in a traditional manner. It will therefore be understood that when the adjustment lever 46 is manipulated, the length of the pneumatic piston 34 can be selectively changed.

A cam guide groove 50 is formed on a surface of the top column section 42. The cam guide groove 50 has an open bottom 52 that aligns with the cam 44 in the bottom column section 40 when the top column section 42 is set within the bottom column section 40. The cam guide groove 50 has a narrow first section 54 that is just slightly wider than the cam 44. Accordingly, when the cam 44 is within the narrow first section 54 of the cam guide groove 50, the top column section 42 is free to move vertically up and down, but any rotational movement is prohibited.

A wide second section 56 of the cam guide groove 50 is present above the narrow first section 54. The wide second section 56 is much wider than the cam 44 but is only slightly taller than the cam 44.

It will be understood provided that when the seat 30 is facing the gaming machine 20, the cam 44 is aligned with the narrow first section 54 of the cam guide groove 50. The top column section 42 is therefore free to move up and down within the bottom column section 40. The seat 30, therefore, is free to be adjusted in height via the pneumatic piston 34. However, the presence of the cam 44 in the narrow first section 54 of the cam guide groove 50 prevents the seat 30 from being rotated out of alignment with the gaming machine 20.

Figure 4:
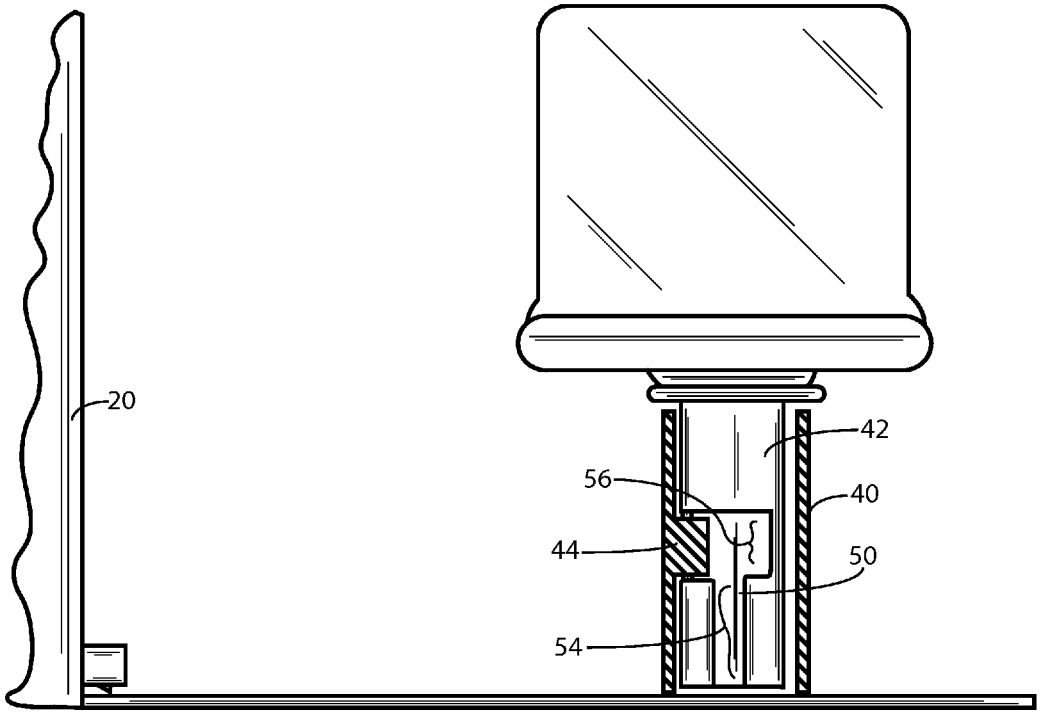
FIG. 4 is a partially cross-sectioned view of the vertical column component shown in a fully retracted position.

Referring to FIG. 4 in conjunction with FIG. 2, it will be understood that if the pneumatic piston 34 is adjusted to its lowest setting, the cam 44 enters the wide second section 56 of the cam guide groove 50. Once at this position, the top column section 42 can rotate ninety degrees, within the horizontal plane, in either direction. Accordingly, the seat 30 that is attached to the top column section 42 can be turned either to the left or to the right into a position perpendicular to the gaming machine 20. Once the cam 44 enters the wide second section 56 of the cam guide groove 50 and is rotated out of alignment with the narrow first section 54 of the cam guide groove 50, the top column section 42 can no longer move up and down. The seat 30, therefore, remains locked in its lowest position and must remain there until the seat 30 is again turned toward the gaming machine 20.

It will therefore be understood that the seat 30 can be lowered and turned ninety degrees away from the gaming machine 20. This enables a patron to sit in the seat without having to stand between the seat 30 and the gaming machine 20. A large patron or a handicapped patron can therefore easily enter the seat 30.

Once seated, a patron turns the seat 30 to face the gaming machine 20. Once so oriented, the seat 30 is free to be adjusted in height to the needs of the patron. The seat 30 cannot again be turned to the side until it is again lowered to its lowest position.

Figure 5:
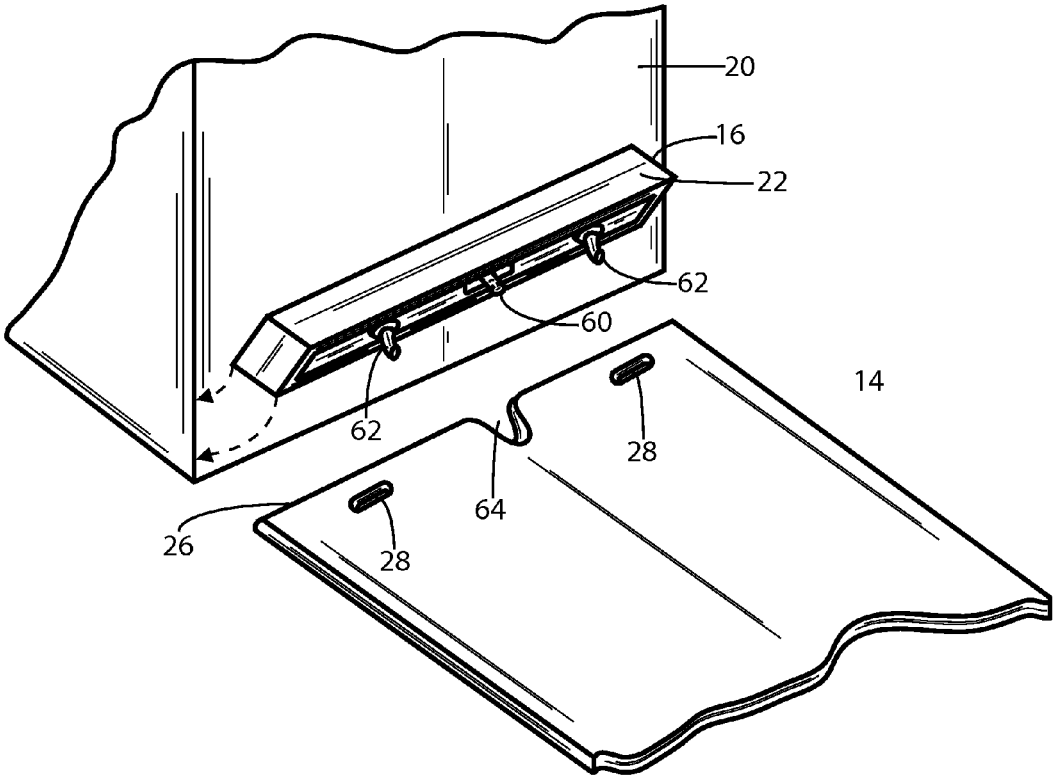
FIG. 5 show a perspective view of the locking mechanism component of the present invention.

Referring now to FIG. 5, it can be seen that the locking mechanism 16 has a housing 22 that is bolted to the vertical face of the gaming machine 20. A guide pin 60 and two locking pawls 62 extend downwardly below the housing 22. The forward edge 26 of the base platform 14 contains a guide relief 64. When the base platform 14 is pushed under the locking mechanism 16, the guide pin 60 enters the guide relief 64 and properly orients the base platform 14 to the locking mechanism 16. As the front edge 26 of the base platform 14 is fully advanced under the locking mechanism 16, the two locking pawls 62 fall into the holes 28 in the base platform 14. This creates a mechanical attachment between the locking mechanism 16 and the base platform 14 that prevents the base platform 14 from being pulled away from the locking mechanism 16 and the gaming machine 20.

Figure 6:
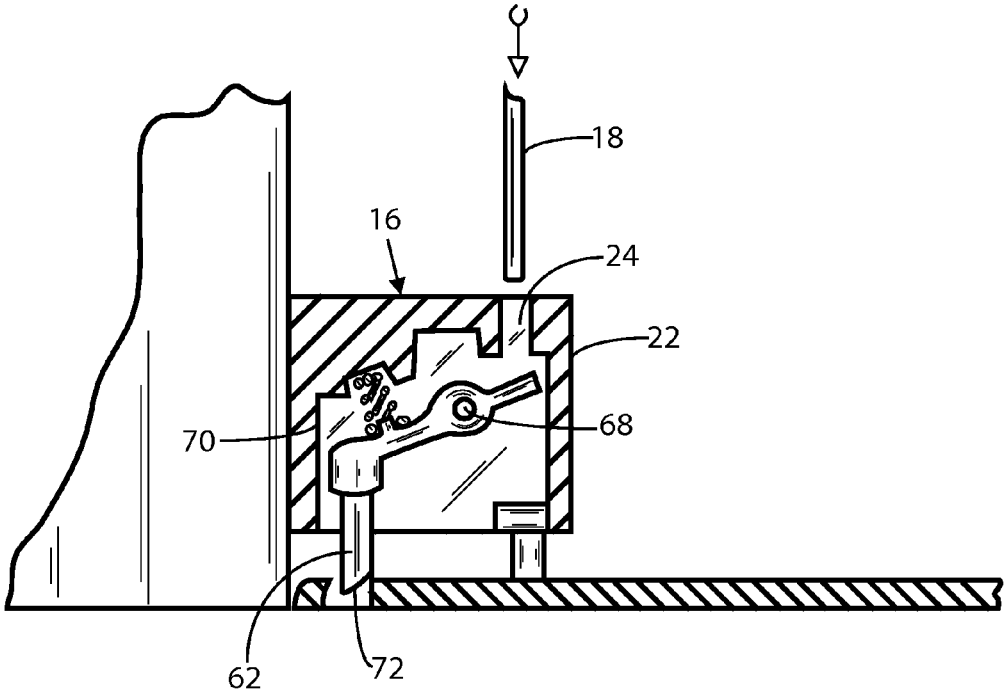
FIG. 6 shows a cross-sectional view of the locking mechanism of FIG. 5.

Referring to FIG. 6 in conjunction with FIG. 5, it can be seen that the locking pawls 62 are disposed at the end of a rocker arm 66. The rocker arm 66 is pivotably connected to the housing 22 at a pivot connection 68. A spring 70 biases the rocker arm 66 into a specific orientation. While in this orientation, the locking pawls 62 are biased downwardly into fully extended positions. However, the locking pawls 62 have a tapered face 72 that cause them to rise against the bias of the spring 70 as the base platform 14 is advanced under the locking mechanism 16 and contacts the locking pawls 62.

The rocker arm 66 passes under the aperture 24 in the housing 22 of the locking mechanism 16. When the elongated actuator 18 is inserted into the aperture 24, the elongated actuator 18 touches the rocker arm 66. With a slight push, the elongated actuator 18 can overcome the bias of the spring 70 and cause the rocker arm 66 to pivot and lift the locking pawls 62 upwardly. If enough force is applied to the elongated actuator 18, the locking pawls 62 can be lifted up enough to disengage the base platform 14. The base platform 14 is then free to be removed from the locking mechanism 16.

The aperture 24 and the elongated actuator 18 can have complex keyed shapes so that only the proper elongated actuator 18 would be able to enter the aperture 24. Such a keyed configuration will help prevent unauthorized people from being able to detach the base platform 14 from the locking mechanism 16.

It can be seen that the pivot connection 68 of the rocker arm 66 and the locking pawls 62 are protected by the housing 22 of the locking mechanism 16. Any debris that were to fall or pour through the aperture 24 in the housing 22 wound fall through to the floor. The locking mechanism 16 is therefore highly protected from fouling due to dirt, spilled drinks, shoe mud or other contamination.

It will be understood that the embodiment of the present invention that is illustrated and described is merely exemplary and that a person skilled in the art can make many variations to that embodiment using functionally equivalent components. For instance, the locking mechanism can have more than one guide pin and more or less than two locking pawls. Furthermore, the design of the seat and the shape of the column supporting the seat can be altered as a matter of design choice. All such variations, modifications and alternate embodiments are intended to be included within the scope of the present invention as defined by the claims.

What is claimed is:

1. A system for mounting a seat to a vertical surface, said system comprising:

a base platform having a front edge and a top surface, wherein at least one hole is disposed in said base platform proximate said front edge;

a seat;

a vertical column having a bottom end that is connected to said top surface of said base platform and a top end that is connected to said seat;

a locking mechanism that is mountable to a vertical surface, wherein said locking mechanism contains at least one pawl that is biased downwardly below said locking mechanism, wherein said at least one pawl automatically engages said at least one hole in said base platform when said base platform is advanced under said locking mechanism, therein joining said base platform to said locking mechanism.

2. The system according to claim 1, wherein said locking mechanism includes a rocker arm having a first side and a second side, wherein said at least one pawl extends downwardly from said first side of said rocker arm.

3. The system according to claim 2, wherein said locking mechanism includes a protective housing having a top surface.

4. The system according to claim 3, wherein an aperture is disposed in said top surface of said protective housing above said second side of said rocker arm.

5. The system according to claim 4, further including an elongated actuator that is sized to pass through said aperture in said top surface of said housing and contact said second side of said rocker arm.

6. The system according to claim 1, wherein said vertical column has a first section and a second section, arranged in a telescoping configuration.

7. The system according to claim 6, further including a piston contained within said vertical column, wherein a first end of said piston is affixed to said first section of said vertical column and a second end of said piston is affixed to said second section of said vertical column.

8. The system according to claim 6, wherein said vertical column is selectively adjustable in length between a fully extended length and a fully contracted length.

9. The system according to claim 8, wherein said first section of said vertical column defines a groove.

10. The system according to claim 9, further including a cam extending inwardly from said second section of said vertical column, wherein said cam rides within said groove in said first section of said vertical column as said vertical column moves between said fully extended length and said fully contracted length.

11. The system according to claim 10, wherein said groove includes a first section and a second section, wherein said cam is restricted to moving vertically in said first section of said groove and moving horizontally in said second section of said groove.

12. A seat assembly for a gaming machine, said assembly including:

a seat facing a first direction;

a base platform;

a telescoping support column that joins said seat to said base platform, said support column having a first section and a second section that interconnect in a telescoping configuration, wherein said support column is selectively adjustable between a fully extended position and a fully retracted positions;

a groove disposed in said first section of said support column, wherein said groove has a narrow region and a wide region;

a cam extending from said second section of said support column that rides in said groove;

wherein said cam rides in said narrow region of said groove and confines said seat in said first direction when said support column is in said fully extended position; and wherein said cam rides in said wide region of said groove and enables said seat to be rotated away from said first direction when said support column is in said fully retracted position.

13. The assembly according to claim 12, further including a piston disposed inside said support column, wherein said piston engages said first section and said second section of said support column at opposite sides of said piston.

14. A seat assembly for a gaming machine, said seat assembly including:

a base platform having a front edge and a top surface, wherein at least one hole is disposed in said base platform proximate said front edge;

a seat;

a vertical column having a bottom end that is connected to said top surface of said base platform and a top end that is connected to said seat;

a locking mechanism that receives and engages said base platform, said locking mechanism having a protective housing with an aperture in a top surface of said protective housing, wherein said locking mechanism releases said base platform when a hard elongated object is pressed down into said aperture with a predetermined force.

15. The assembly according to claim 14, wherein said locking mechanism includes a rocker arm having a first section and a second section on opposite sides of a pivot point, wherein pawls extend downwardly from said first section of said rocker arm to engage said base platform.

16. The assembly according to claim 15, wherein said second section of said rocker arm is disposed under said aperture in said protective housing so as to be contacted and moved by any hard object inserted through said aperture.

* * * * *